US007367089B2

(12) United States Patent
Cooke et al.

(10) Patent No.: US 7,367,089 B2
(45) Date of Patent: May 6, 2008

(54) PROTECTIVE COVER FOR A HANGING CLIP OF A TAPE MEASURE, KNIFE, OR OTHER PORTABLE OBJECT

(76) Inventors: Ronald A. Cooke, 3386 Falling Brook Dr., Marietta, GA (US) 30062; Joseph V. Montgomery, Jr., 8875 Vanns Tavern Rd., Gainesville, GA (US) 30506

( * ) Notice: Subject to any disclaimer, the term of this patent is extended or adjusted under 35 U.S.C. 154(b) by 312 days.

(21) Appl. No.: 11/074,853

(22) Filed: Mar. 8, 2005

(65) Prior Publication Data

US 2005/0194411 A1 Sep. 8, 2005

Related U.S. Application Data

(60) Provisional application No. 60/551,175, filed on Mar. 8, 2004.

(51) Int. Cl.
*A44B 21/00* (2006.01)

(52) U.S. Cl. ..... 24/3.12; 24/570; 33/755

(58) Field of Classification Search ..... None
See application file for complete search history.

(56) References Cited

U.S. PATENT DOCUMENTS

| | | | | |
|---|---|---|---|---|
| 668,088 | A * | 2/1901 | Bruce | 24/3.12 |
| 1,281,656 | A | 10/1918 | Raschick | |
| 4,897,898 | A | 2/1990 | Chapin | |
| 5,890,478 | A * | 4/1999 | Dunmore | 124/86 |
| 6,018,848 | A | 2/2000 | Nilsen et al. | |
| 6,226,886 | B1 * | 5/2001 | Lamond et al. | 33/769 |
| 6,594,865 | B2 | 7/2003 | O'Mahony | |

* cited by examiner

*Primary Examiner*—Jack W. Lavinder
(74) *Attorney, Agent, or Firm*—Gardner Groff Greenwald & Villanueva, PC

(57) ABSTRACT

A protective body has an opening for receiving a hanging clip of a tape measure, knife, or other portable object. The protective body and opening are preferably sized and shaped to receive substantially all of the hanging clip, or at least the region of the clip immediately adjacent to the object, to cover any unsmooth edges of the hanging clip so they do not cut into the wear's belt, pocket, etc.

4 Claims, 6 Drawing Sheets

FIG. 10
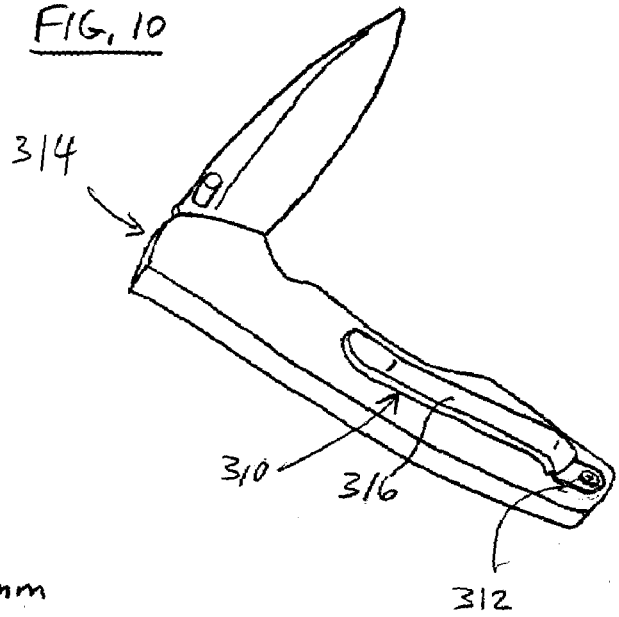
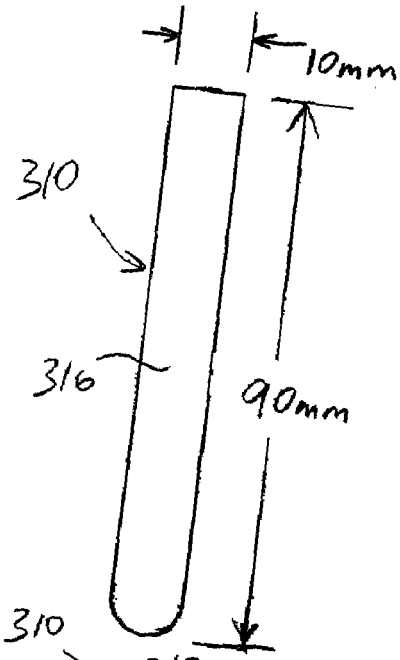
FIG. 11
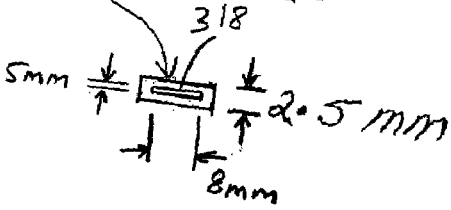
FIG. 12

PROTECTIVE COVER FOR A HANGING CLIP OF A TAPE MEASURE, KNIFE, OR OTHER PORTABLE OBJECT

CROSS-REFERENCE TO RELATED APPLICATION

This application claims the priority benefit of U.S. Provisional Patent Application Ser. No. 60/551,175, filed Mar. 8, 2004, the entire scope and content of which is hereby incorporated herein by reference.

TECHNICAL FIELD

The present invention relates generally to tools and other objects with a clip for hanging from a user's belt, pocket, etc. and, in particular, to a protective cover for such clips.

BACKGROUND OF THE INVENTION

Cabinet makers, furniture makers, and other craftsmen typically use a tape measure on a frequent basis. Conventional tape measures have a hanging clip that allows the user to hang his tape measure from his pants pocket or belt for convenience. But these clips are usually made of metal and have unsmooth edges that often cut into the user's pants. Over time, their pants get shredded to the point of becoming unsightly and even unwearable.

In addition, craftsmen, hunters, and others often carry a knife that they use frequently. Some knives have metal hanging clips that allow the user to hang his knife from his pants pocket or belt for convenience. But these clips suffer from the same problem of unsmooth edges shredding the user's clothing over time.

Accordingly, it can be seen that a need exists for a way to protect a person's pants and/or other clothing from being damaged by the edges of a hanging clip of a tape measure, knife, or other portable object hung from the person's belt, pants pocket, etc. It is to the provision of a way to protect clothing from such damage that the present invention is primarily directed.

SUMMARY OF THE INVENTION

Generally described, the present invention provides a protective cover for a hanging clip of an object such as a tape measure, knife, or other portable item with a hanging clip for suspending from a user's pocket, belt, belt loop, or other clothing article. The cover has a body with an opening that receives at least a portion of the hanging clip so that edges of the clip are covered and prevented from contacting and damaging a person's clothing adjacent to where the object is hung by the clip.

In a first example embodiment of the invention, at least a portion of the body is made of a deformable material. The deformable material has an elasticity that permits the body to deform to an S-shaped or other non-linear shape of the clip as the body is slipped over the clip. For example, the material may be a plastic, rubber, polymer, foam, or composite.

In addition, the cover body has a length and the body opening has a length that are selected so that the cover body covers the edges of at least a weight-supporting segment of the clip. Preferably, the cover body length and the body opening length are selected so that the opening receives all or substantially all of that portion of the clip that extends from the object, and so that the cover body covers the clip from a clip region immediately adjacent to the object main body to and beyond an opposite outer end of the clip. Furthermore, the cover body has a thickness and the body opening has a thickness that are preferably selected so that the body opening receives the clip with a snug fit to frictionally secure the clip in the opening during use.

In a second example embodiment, the cover body and the body opening are generally S-shaped and generally conform to an S-shaped clip. And in a third example embodiment, the cover has a body in the form of a sheet of material with a portion including a fastening structure, wherein the sheet includes a first segment for positioning on a back side of the clip, a second segment for folding over onto a front side of the clip, and a third segment for folding over onto the second segment and fastening in place.

In another aspect, the invention includes the combination of the protective cover and the portable object, with the cover installed on the hanging clip of the object. As mentioned hereon, the portable object may be a tape measure, knife, or other item with a hanging clip for suspending from a user's pocket, belt, belt loop, or other clothing article.

And in still another aspect, the invention includes a method of manufacturing the tape measure, knife, or other portable object. The method includes the steps of providing a main body of the portable object, providing a hanging clip configured for suspending from the user's clothing, applying a protective cover onto the clip, and attaching the clip to the main body. Preferably, the step of applying the protective cover includes dipping the clip into a container of a material in liquid form, and then curing the material into a solid form.

Accordingly, the present invention provides protective covers for installing over unsmooth edges of the hanging clip of tape measure, knives, and other portable objects. In this way, the covered edges do not contact and damage the user's clothing adjacent to where the hanging clip is suspended. In addition, the protective covers of the present invention are easy and inexpensive to manufacture, install, and use. Furthermore, the present invention provides a method of manufacturing the protective covers that is particularly easy and inexpensive.

The specific techniques and structures employed by the invention to improve over the drawbacks of the prior devices and accomplish the advantages described herein will become apparent from the following detailed description of the example embodiments of the invention and the appended drawings and claims.

BRIEF DESCRIPTION OF THE DRAWINGS

FIG. 10 is a perspective view of a clip cover according to a fourth example embodiment of the present invention, showing the clip cover installed on a hanging clip of a knife.

FIG. 11 is a side view of the clip cover of FIG. 10, showing dimensions of a typical commercial embodiment.

FIG. 12 is a front view of the clip cover of FIG. 11, showing additional dimensions of a typical commercial embodiment.

DETAILED DESCRIPTION OF EXAMPLE EMBODIMENTS

Figure 2:
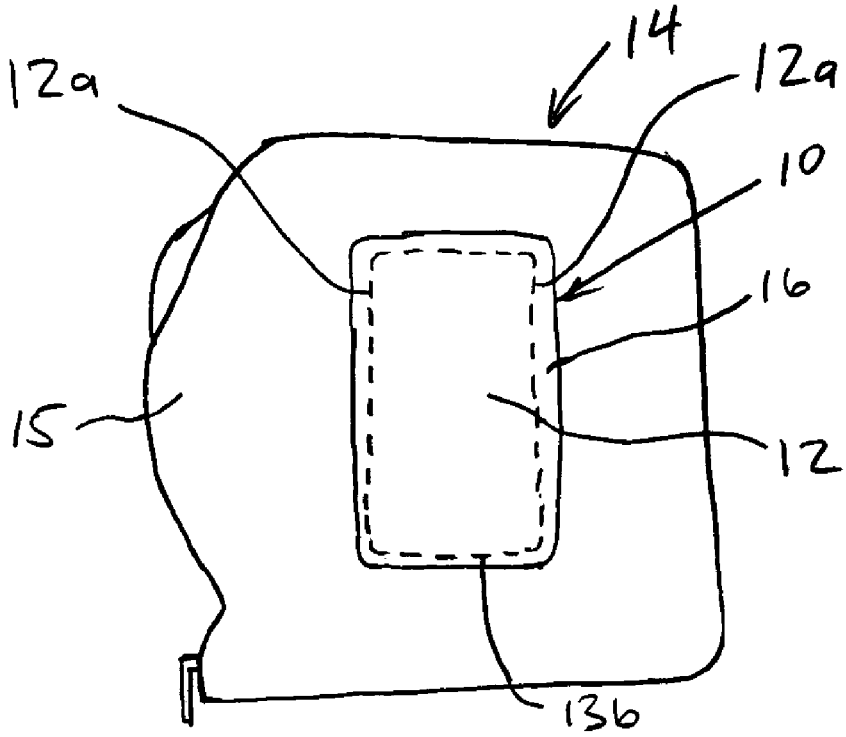
FIG. 2 is a right side view of the clip cover and tape measure of FIG. 1.
Figure 1:
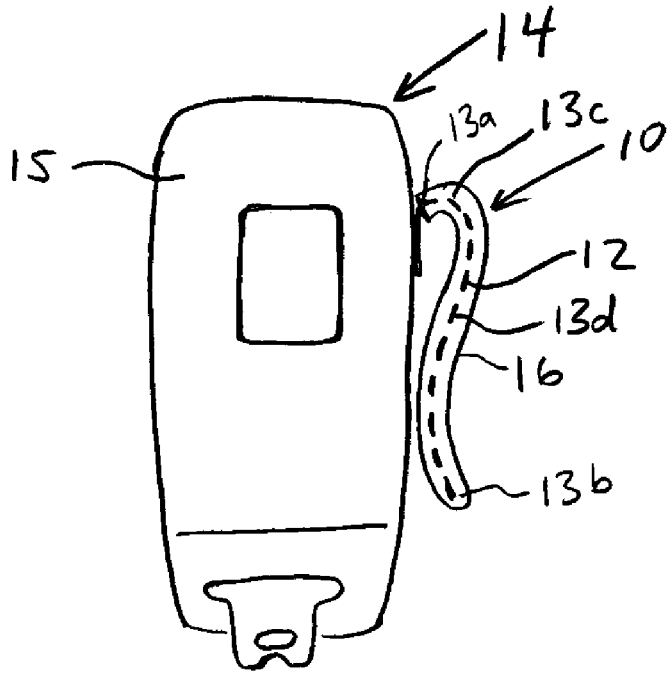
FIG. 1 is a front view of a clip cover according to a first example embodiment of the present invention, showing the clip cover installed on a hanging clip of a tape measure.
Figure 3:
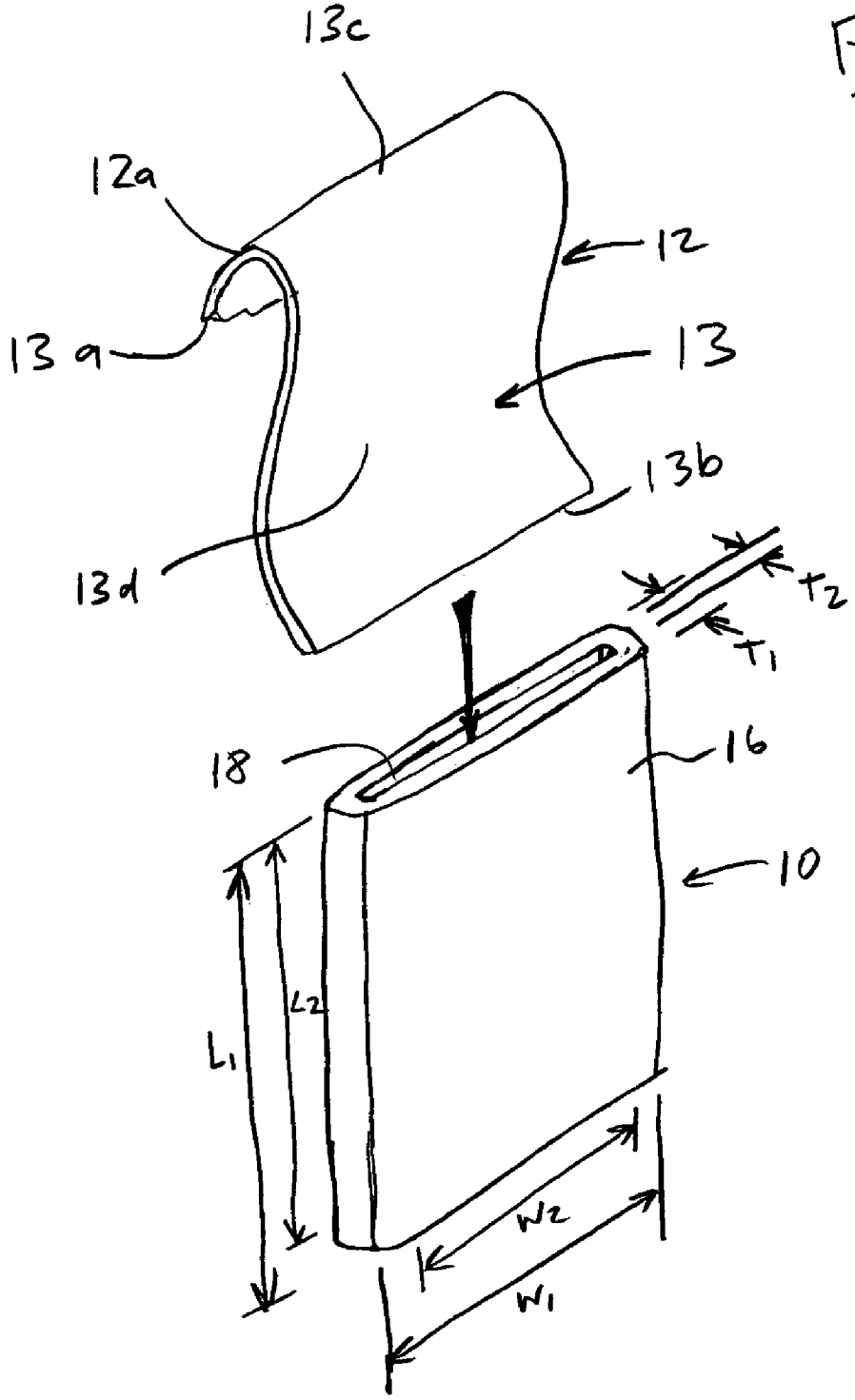
FIG. 3 is a perspective view of the clip cover and the tape measure's hanging clip of FIG. 1, showing the clip cover being installed on the hanging clip.
Figure 4:
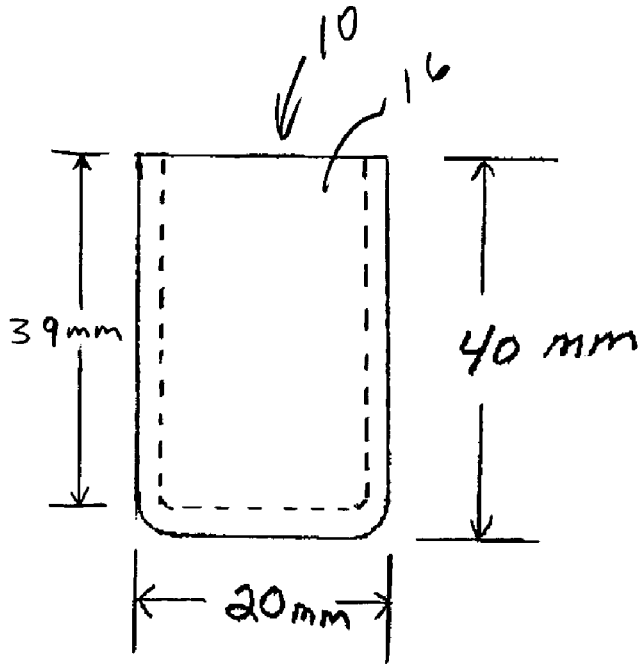
FIG. 4 is a side view of the clip cover of FIG. 1, showing dimensions of a typical commercial embodiment.
Figure 5:
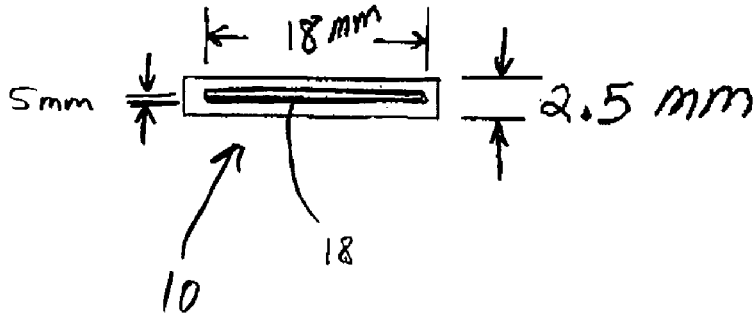
FIG. 5 is a front view of the clip cover of FIG. 4, showing additional dimensions of a typical commercial embodiment.

Referring now to the drawing figures, FIGS. 1-5 show a clip cover 10 according to a first example embodiment of the present invention. The cover 10 is designed for use with a hanging clip 12 of a portable object such as a tape measure 14. It will be understood that the cover 10 can be readily adapted for use with other portable objects having hanging clips for suspending the object from a user's clothing, such as but not limited to keychain fobs, pagers, beepers, cell phone cases, some knife sheaths, and glasses cases.

The clip cover 10 comprises a body 16 made of a deformable material and having an opening 18 for receiving at least a portion of the clip 12 so that the unsmooth edges 12*a* of the clip that contact a wearer's belt, pocket, belt loop, etc. are covered. To install the cover 10, you simply push the clip 12 into the opening 18 of the body 16 as far as it will go. In this way, the user can install the cover 10 onto the clip 12 and wear the tape measure 14 without the edges 12*a* damaging the user's clothing.

The deformable material of the body 16 may be a plastic, rubber, polymer, foam, composite, or another material with an elasticity that permits the body to deform to the shape of the clip 12 as the body is slipped over the generally S-shaped (as shown in the figures), 7-shaped, or other-shaped clip. The body 16 can be made by conventional fabrication techniques, for example, by molding. The opening 18 may be in the shape of a slit, slot, or otherwise-configured opening. And the opening 18 may be formed when molding the body, formed into the body 16 after it is made, or otherwise constructed.

The body 16 and opening 18 are sized and shaped so that the cover 10 fits over a substantial portion of the clip 12. Preferably, the body 16 has a length L1 and the opening 18 has a length L2 that are selected so that the opening 18 receives all or substantially all of that portion of the clip 12 that extends from the main body 15 of the tape measure 14. That is, the cover body length L1 and body opening length L2 are preferably selected so that the cover body 16 covers the clip 12 beginning from the clip region 13*a* immediately adjacent to the tape measure main body 15 (i.e., where the clip begins to extend away from the main body) and, at the opposite end, extends beyond and covers the outer end 13*b* of the clip (see FIG. 1). For example, in a typical commercial embodiment, the cover body length L1 is about 40 mm and body opening length L2 is about 39 mm.

At a minimum, the cover body length L1 and body opening length L2 are selected so that the cover body 16 covers the edges 12*a* of the weight-supporting segment 13*c* of the clip 13. The weight-supporting clip segment 13*c* is the upper portion of the clip where all or most all of the weight of the tape measure 14 is supported. The weight-supporting clip segment 13*c* extends generally laterally away from the main body 15, and extends generally from the clip region 13*a* to the generally vertical, more-elongated holder segment 13*d* of the clip 13. It will be understood that other lengths may be selected when making clip covers for clips of larger or smaller lengths.

In addition, the thickness T1 of the body 16 and the thickness T2 of the body opening 18 are preferably selected so that the body opening 18 receives a typical clip 12 with a snug fit to frictionally secure it in place in the opening so that the cover 10 does not come off when removing the tape measure 14 from the user's belt or pocket. For example, in a typical commercial embodiment, the cover body thickness T1 is about 2.5 mm and the body opening thickness T2 is about 0.5 mm. Other thicknesses may be selected when making clip covers for clips of larger or smaller thicknesses.

Furthermore, the width W1 of the body 16 and the width W2 of the body opening 18 are preferably selected so that the body opening can receive most sizes of clips 12 on commercially available tape measures. For larger width clips, the cover 10 will fit just right. For smaller width clips, the cover 10 will still fit snugly due to the frictional forces from the thicknesses T1 and T2 being the same. But the widths W1 and W2 will be slightly oversized, which will not impair the function of the cover 10. For example, in a typical commercial embodiment, the cover body width W1 is about 20 mm and the body opening width W2 is about 18 mm. Other widths may be selected when making clip covers for clips of larger or smaller widths.

In an alternative embodiment, the cover body has an opening that extends all the way through the body. In this embodiment, the clip can be inserted into either end of the cover. In addition, the cover can be used with a wide range of clip lengths. For shorter clips, the cover will extend beyond and cover the outer end of the clip. And for longer clips, the clip will extend all the way through the opening with the outer end of the clip extending out of the second open end of the body but with at least the weight-supporting clip segment covered. To reduce or eliminate possible snagging of the user's clothes by this exposed portion of the clip, the cover can be provided with a tapered end. Or the cover can be made for length adjustment by the user to fit his tape measure, with one or more scored sections that can be easily torn away by hand or with a wall thickness and material selected so that the body can be readily cut through with a conventional scissors.

In another alternative embodiment, the cover is made in a number of different sizes with body and opening lengths, thicknesses, and widths selected for accommodating only one, just a few, or a number of specific clip sizes. In still another alternative embodiment, the cover has a smaller length (e.g., about ½ inch, so that the body's width is greater than its length) and is in the form of a circumferential band that slides up onto the clip or a C-shaped band that can be bent open to clip onto the clip to cover the edges of only the weight-supporting clip segment 13*c*. In yet another alternative embodiment, the opening has a fastening structure (e.g., epoxy, set screw) for securing or helping to secure the clip in the opening. And in still another alternative embodiment, the cover has a body with an outer layer that is made of a rigid material and an inner layer that is made of the elastic deformable material for conforming to the shape of the clip.

Figure 6:
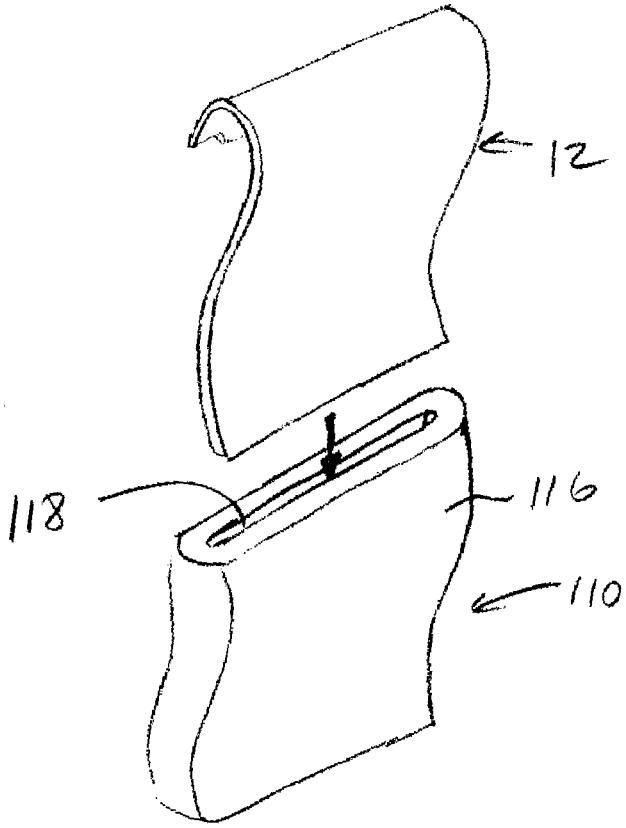
FIG. 6 a perspective view.
Figure 6A:
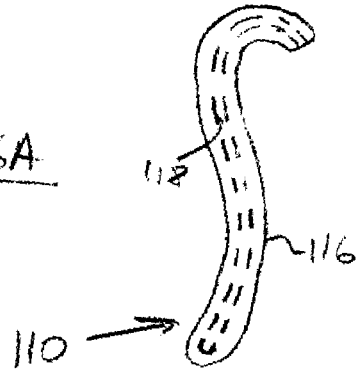
FIG. 6A is a side view, of a clip cover according to a second example embodiment of the present invention, showing the clip cover being installed on a hanging clip.

FIGS. 6 and 6A show a clip cover 110 according to a second example embodiment of the present invention that is similar to the cover 10 of the first example embodiment. In this embodiment, however, the cover 110 has a body 116 and an opening 118 with a shape that generally conforms to the shape of the clip 12. For example, for use with a typical clip 12 that is generally S-shaped, the cover body 116 and opening 118 are also generally S-shaped, as shown. In this way, when the cover body 116 in installed in place on the clip 112, it will fit more snugly and stay in place better, and will be less subject to cracking from stresses and strains caused by the curved shape a flat cover body would be forced into by the curved clip.

Figure 7:
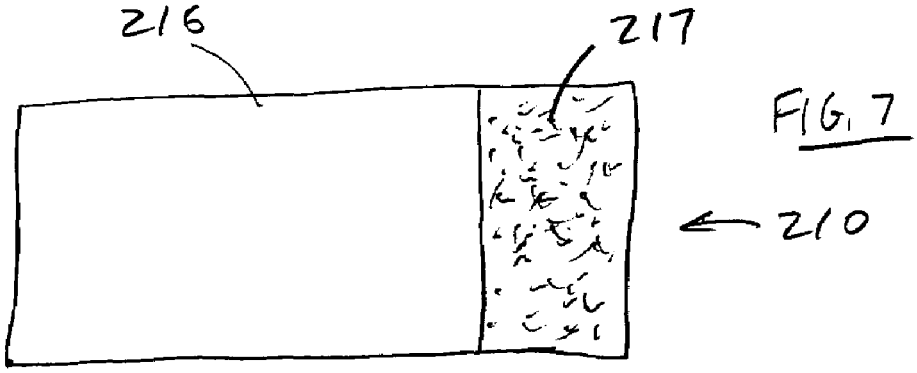
FIG. 7 is a side view of a clip cover according to a third example embodiment of the present invention, showing the clip cover in its flat, uninstalled position.
Figure 8:
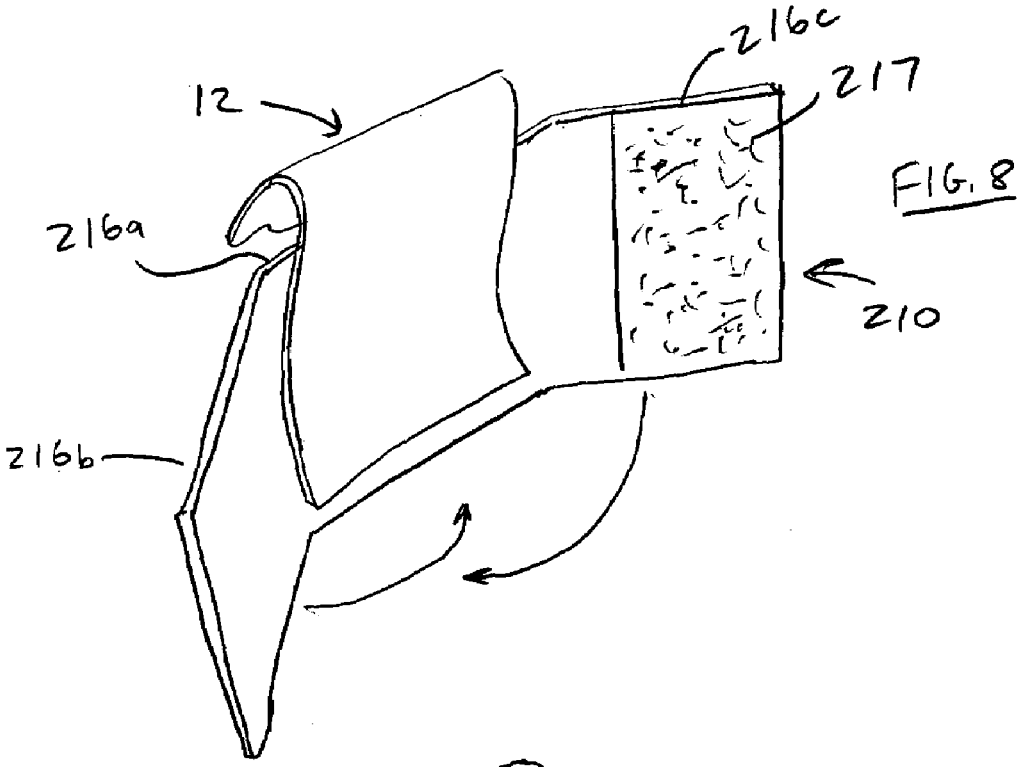
FIG. 8 is a perspective view of the clip cover of FIG. 7, showing the clip cover being installed on a hanging clip.
Figure 9:
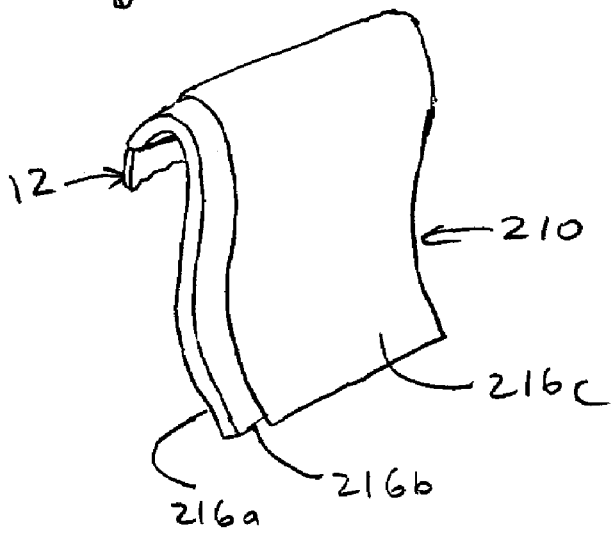
FIG. 9 is a perspective view of the clip cover and hanging clip of FIG. 8, showing the clip cover fully installed on the hanging clip.

FIGS. 7-9 show a clip cover 210 according to a third example embodiment of the present invention that is similar to the cover 110 of the second example embodiment. In this embodiment, however, the cover 210 has a body 216 in the form of a sheet of material with a portion including a fastening structure 217 such as an adhesive or other adherent substance, hook-and-loop (VELCRO) fasteners, or other fastening structures known in the art. To install the cover 210, a first segment 216*a* of the body 216 is positioned on the back side of the clip 12, a second segment 216*b* is folded over onto the front side of the clip, and then a third segment 216*c* is folded over onto the second segment 216*b* and fastened in place. This permits one size of cover to be used with any width and thickness of clip. And in an alternative embodiment, the sheet of material has an adherent layer on all or substantially all of one side, similar to a piece of tape, so that the first and second segments are secured directly to the clip.

FIGS. 10-12 shows a clip cover 310 according to a fourth example embodiment of the present invention that is similar to the cover 10 of the first example embodiment. In this embodiment, however, the cover 310 is sized for use with a hanging clip 312 on a knife 314. For example, in a typical commercial embodiment, the body 316 and the opening 318 of the cover 310 has the lengths, thicknesses, and widths shown in FIGS. 11 and 12, which dimensions are for a smaller embodiment. Other dimensions may be selected for making clip covers for clips that have different dimensions, with the dimensions selected for covering the edges of the clip to prevent damage to the wear's clothing. For example, in a larger embodiment, the body is about 100 mm long and about 40 mm wide. In addition, it will be understood that the alternative embodiments described herein for the cover for a tape measure clip can be readily adapted into a cover for a knife clip.

In addition, the present invention includes a method of manufacturing a tape measure, knife, or other object having a clothing-protected hanging clip. The hanging clip and its protective cover look substantially similar to the cover 10 shown in FIGS. 1 and 2. It should be noted that the cover 10 of the first embodiment may be provided as an aftermarket item for individuals to install on their existing tape measures 14, or it may be pre-manufactured then factory-installed onto tape measures 14 for their initial purchase. By the present method, however, the cover is formed onto the clip during the manufacturing process of the tape measure, knife, or other object.

The method of manufacture comprises the steps of (a) providing a portable object such as a tape measure body or knife body; (b) providing a hanging clip; (c) applying a protective cover onto the clip; and (d) attaching the clip to the portable object. Preferably, the step of applying the cover onto the clip includes dipping the clip into a container of a material in liquid form, and then curing the material into a solid form. The material may be of a similar composition to that used in the cover 10 of the first embodiment. This dipping step may be done manually (by hand dipping) or by an automated manufacturing process.

Accordingly, it can be seen that the present invention provides protective articles that install over a hanging clip of a tape measure, knife, or other portable object. In addition, the present invention provides a method of manufacturing a tape measure, knife, or other portable object having a hanging clip and a protective cover. Advantageously, the present invention protects a person's pants, belt, and/or other clothing from being damaged by the edges of the hanging clip.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A cover for a hanging clip of a portable hand tool, the clip being of a one-piece construction having a first end segment fixedly attached to a main body of the hand tool, a second free end segment, a generally horizontal weight-supporting segment therebetween, and a generally vertical holder segment between the weight-supporting segment and the free end segment, with the weight-supporting segment at a higher position than the attached end segment, the holder segment, or the free end segment so that the hand tool can be suspended from a pants pocket or belt with the weight-supporting segment engaging the pants pocket or belt to support the weight of the hand tool in suspension, wherein the cover comprises:

a body of a one-piece construction having at least a portion that is made of a deformable material, wherein the deformable material is a plastic, rubber, polymer, foam, or composite and has an elasticity selected to permit the body to deform to a non-linear shape as the body is slipped onto the clip; and the body defining an opening that receives at least a portion of the hanging clip therein, wherein the cover body has a length and the body opening has a length that are selected so that edges of the weight-supporting segment, the holder segment, and the free end segment of the clip are covered and prevented from contacting and damaging the pants pocket or belt engaged by the weight-supporting segment, the holder segment, and the free end segment when the hand tool is hung by the clip on the pants pocket or belt and repeatedly removed therefrom and replaced thereon throughout a workday, wherein the cover body length and the body opening length are selected so that the opening receives all or substantially all of the clip that extends from the main body of the hand tool, and wherein the cover body has a thickness and the body opening has a thickness that are selected so that the body opening receives the clip with a snug fit to frictionally secure the clip in the opening of the cover body during use.

2. The cover of claim 1, wherein the clip is generally S-shaped, wherein the cover body and the body opening are generally S-shaped and generally conform the S-shape of the clip.

3. The cover of claim 1 in combination with the portable hand tool of claim 1.

4. The combination cover and portable object of claim 3, wherein the portable hand tool is a tape measure or a knife.

* * * * *